US012060526B2

(12) United States Patent
Respini et al.

(10) Patent No.: US 12,060,526 B2
(45) Date of Patent: Aug. 13, 2024

(54) ADDITIVES FOR REMOVAL AND FOULING MITIGATION OF RESIDUA FROM WASTE PLASTICS PYROLYSIS

(71) Applicant: Baker Hughes Oilfield Operations LLC, Houston, TX (US)

(72) Inventors: Marco Respini, Casalmorano (IT); Constance Jean, Liverpool (GB)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 0 days.

(21) Appl. No.: 17/826,960

(22) Filed: May 27, 2022

(65) Prior Publication Data

US 2023/0383192 A1 Nov. 30, 2023

(51) Int. Cl.
*C10G 1/10* (2006.01)
*C10G 1/00* (2006.01)

(52) U.S. Cl.
CPC ..... *C10G 1/10* (2013.01); *C10G 1/002* (2013.01); *C10G 2300/1003* (2013.01); *C10G 2300/201* (2013.01); *C10G 2300/80* (2013.01)

(58) Field of Classification Search
CPC .. C10G 1/10; C10G 1/002; C10G 2300/1003; C10G 2300/201; C10G 2300/80
See application file for complete search history.

(56) References Cited

U.S. PATENT DOCUMENTS

| | | | | |
|---|---|---|---|---|
| 4,552,732 | A * | 11/1985 | Hillekamp | B01D 53/34 55/474 |
| 5,149,424 | A | 9/1992 | Lundquist | |
| 9,290,584 | B2 | 3/2016 | Ng et al. | |
| 2018/0355263 | A1 | 12/2018 | Moore et al. | |
| 2021/0163326 | A1 | 6/2021 | Ren et al. | |
| 2021/0301209 | A1* | 9/2021 | Timken | C10G 1/002 |
| 2022/0098491 | A1 | 3/2022 | Abbott et al. | |

FOREIGN PATENT DOCUMENTS

| | | | |
|---|---|---|---|
| WO | 2019100145 | A1 | 5/2019 |
| WO | 2021204820 | A1 | 10/2021 |
| WO | WO-2023279022 | A1 * | 1/2023 |

OTHER PUBLICATIONS

International Search Report and Written Opinion issued in connection with corresponding PCT Application No. PCT/US2023/023765, dated Sep. 15, 2023.
Liu; Sibao; et al., Plastic waste to fuels by hydrocracking at mild conditions,Science Advances, Apr. 1-9, 2021.

* cited by examiner

*Primary Examiner* — Thuan D Dang
(74) *Attorney, Agent, or Firm* — Crowe & Dunlevy, P.C.

(57) ABSTRACT

A method for removing contaminants from a waste plastics pyrolysis stream containing the contaminants by introducing an effective amount of an additive thereto and separating the contaminants from the stream by a physical process, where suitable additives include, but are not necessarily limited to, crude oil demulsifiers, crude oil wax control additives, crude oil pour point reducers, dispersants/antifoulants, nanoscale metallic oxides, overbased metal oxide carbonates, and combinations thereof.

11 Claims, 7 Drawing Sheets

Blank

Demulsifier

Phosphate Ester Crude Antifoulant + Crude Wax Dispersant

Mag Overbase

Dispersant

Blank

Demulsifier

Phosphate Ester Crude Antifoulant + Crude Wax Dispersant

Mag Overbase

Dispersant

ADDITIVES FOR REMOVAL AND FOULING MITIGATION OF RESIDUA FROM WASTE PLASTICS PYROLYSIS

TECHNICAL FIELD

The present invention relates to methods for separating contaminants from waste plastics pyrolysis streams, and more particularly relates to methods for separating solid contaminants from waste plastics pyrolysis streams by adding an effective amount of an additive and then separating the contaminants from the stream by a physical process.

BACKGROUND

It is well known that there is a very large amount of waste plastics in the world that is an enormous disposal problem with adverse effects on the environment. One approach for dealing with waste plastics is through conversion of waste plastic to lower molecular weight hydrocarbon materials, particularly valuable hydrocarbon materials such as hydrocarbon fuel materials. The decomposition of hydrocarbon polymers of waste plastics, which can have high molecular weights (i.e., long carbon-chain lengths) gives lower molecular-weight hydrocarbons (i.e., shorter carbon-chain lengths) that may be useful as fuels.

Producing fuel and other valuable low molecular weight hydrocarbon materials from the pyrolysis (thermal decomposition) of waste plastic may have environmental benefits both with respect to less reliance on traditional fuel production processes that may generate larger amounts of pollution and reduced levels of plastic waste sent to landfills or incinerated. Fuel production from decomposed waste plastic may also have advantages over other current alternative energy sources, such as for instance crop-plant biomass fuels (bio-fuels) and wind generators.

However, the residua of the waste plastic to fuel conversion process, also called waste plastics pyrolysis streams herein, typically contain considerable unwanted contaminants, in particular solids. These solids are not soluble in the residue matrix. The contaminants are unconvertible products of polymer processes and pyrolysis by-products that behave like insoluble coke. They also contain fouling material made of rather insoluble polynuclear aromatics and small unconverted polymers which makes them difficult for further processing at refinery units (e.g., crude units, thermal cracking units, hydrocracking units, etc.). These organic solids can contain a high level of metals; namely, metals coming from the catalysts left in the plastic matrix during polymerizations or from plastic additives. This residue is typically about 10% of the feed to the conversion units for pyrolysis/thermal decomposition waste plastic processes.

It is thus desirable to develop a method and compositions for removing these contaminants from waste plastics pyrolysis streams.

SUMMARY

There is provided, in one form, a method for removing contaminants from a waste plastics pyrolysis stream containing the contaminants, where the method includes introducing to the waste plastics pyrolysis stream containing contaminants an effective amount to at least partially remove the contaminants therefrom of at least one additive selected from the group consisting of crude oil demulsifiers, crude oil wax control additives, crude oil pour point reducers, dispersants/antifoulants, nanoscale metallic oxides, overbased metal oxide carbonates, and combinations thereof, and then separating the contaminants from the waste plastics pyrolysis stream by a physical process.

Additionally, there is provided a treated waste plastics pyrolysis stream that includes waste plastics from pyrolysis, contaminants, and an effective amount of an additive to at least partially remove the contaminants from the waste plastics pyrolysis stream, where the additive is selected from the group consisting of crude oil demulsifiers, crude oil wax control additives, crude oil pour point reducers, dispersants/antifoulants, nanoscale metallic oxides, overbased metal oxide carbonates, and combinations thereof.

BRIEF DESCRIPTION OF THE DRAWINGS

FIG. 3 is FIGS. 3A-3C are a series of microphotographs of unsettled material on top of the settler after 30 minutes of static settling at 80° C. for:

FIG. 3A which is a blank;

FIG. 3B after treatment with a demulsifier; and

FIG. 3C after treatment with a combination of phosphate ester crude antifoulant and crude wax dispersant;

FIGS. 4A and 4B are two microphotographs of unsettled material on top of the settler after 30 minutes of static settling at 80° C. for:

FIG. 4A after treatment with a mag overbase; and

FIG. 4B after treatment with a dispersant for asphaltenes;

FIGS. 8A-8C are a series of microphotographs of unsettled material on top of a centrifuge tube after static settling following 30 minutes of centrifugation at 80° C. for:

FIG. 8A which is a blank;

FIG. 8B after treatment with a demulsifier; and

FIG. 8C after treatment with a combination of phosphate ester crude antifoulant and crude wax dispersant; and FIGS. 9A and 9B are two microphotographs of unsettled material on top of a centrifuge tube after static settling following 30 minutes of centrifugation at 80° C. for:

FIG. 9A after treatment with a mag overbase; and

FIG. 9B after treatment with a dispersant for asphaltenes.

DETAILED DESCRIPTION

Figure 1:
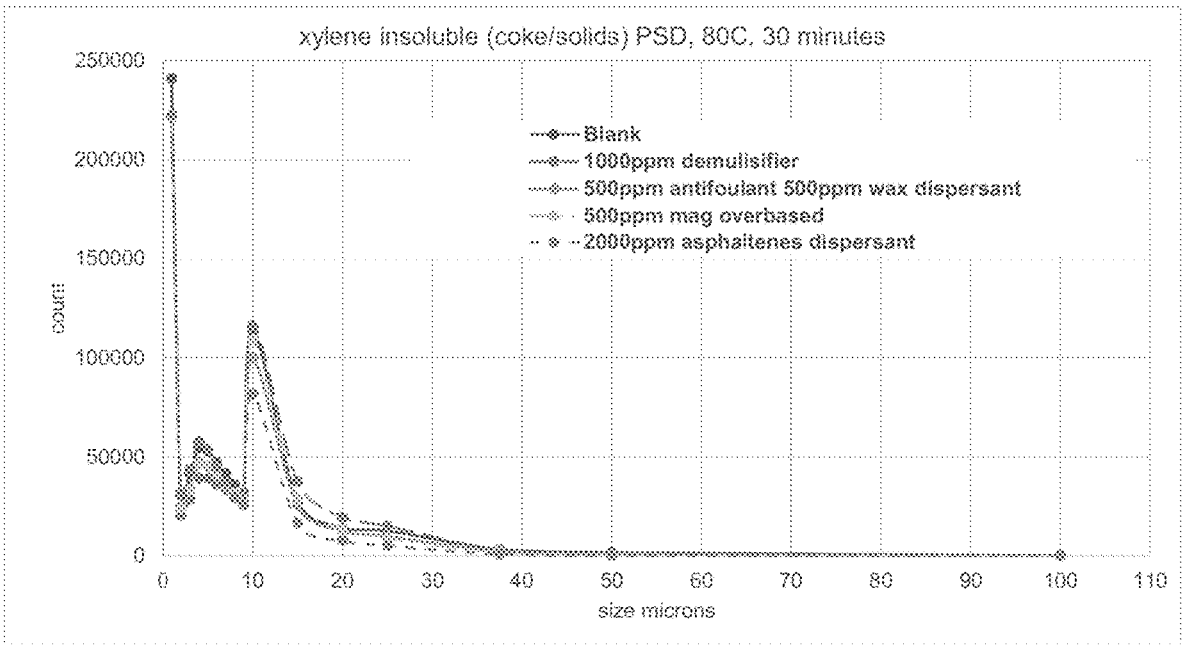
FIG. 1 is a graph of solids that are not removed as a function of size for waste plastic residuum of a blank and three examples using different additives at the indicated dosages after 30 minutes static settling at 80° C.

Waste plastic residua is the unconverted residue from waste plastic pyrolysis. Waste plastic pyrolysis converts polymers into hydrocarbons/fuel distillates by bond breaking while residuum is the portion not converted (not decomposed or retropolymerized/condensed into non distillable fraction), which is a byproduct that can be partially reused (recycled back to the pyrolysis reactor) and partially sent to other refinery conversion processes (mainly visbreaking and delayed coking), but only after the removal of solid contaminants. As defined herein, the solid contaminants include, but are not necessarily limited to, carbon material, carbon-type materials, organic polymers, inorganic solids including metal particles, including metals trapped within solids (e.g., metal particles trapped within organic polymers), and combinations of these. "Carbon-type materials" include, but are not necessarily limited to carbon nanomaterials (CNMs).

It has been discovered that certain additives introduced into waste plastics pyrolysis streams can improve the removal of unwanted fouling solids, coke and barely soluble material like polynuclear aromatics and asphaltenic material and associated contaminants therefrom. The additives improve the rate and amount of removal by settling and/or centrifugation or other separation techniques and processes. Moreover, the solids are dispersed, and asphaltenic-type material is stabilized versus problematic aggregation and phase separation. By "stabilized" is meant that it does not precipitate, or precipitation is inhibited or prevented. The methods and additives described herein are therefore relevant for improving the feasibility of a waste plastic to fuel process, and integration of such a process with petroleum refineries. Without such a method for removing contaminants, the untreated residue would limit the process application and economics of such a waste plastic to fuel process. In other words, it would be uneconomical to use such a process.

Conventional settling and centrifugation are effective physical ways to remove solids, but they are typically slow and/or only partially remove unwanted metal contaminants associated with the solids. It has been discovered that the efficiency and speed of the removal process can be much improved by introduction of the additives described herein, resulting in "cleaner" and easier to process plastics residue that is suitable for processing at refinery units, for example as a co-feed to visbreakers and delayed cokers. Apart from the removal of unwanted metallic contaminants, the removal of insoluble solids reduces the fouling and/or coking tendency to levels that allow processing of the residue at refinery plants. Moreover, the fouling problem of asphaltenic-like material from pyrolysis/thermal degradation can be reduced and mitigated.

The method and additives described herein improve the flexibility and feasibility of using waste plastics pyrolysis streams to fuel processes because they make the residue from plastics processing suitable for further conversion. This avoids the generation of about 10% unusable residual waste from the plastic to oil or fuel processes, thus making this waste usable as a feed to petroleum refinery processes.

The introduction of effective amounts of the additives improves the efficiency of solids and metals contaminants by physical processes including, but not necessarily limited to, settling and/or centrifugation. These additives improve the efficiency of the removal of solids and metal contaminants by centrifugation and/or settling, which makes the processes much faster and effective. Apart from the removal of contaminants, the fouling tendency of the remaining low solubility components, asphaltic-type materials from polymers pyrolysis and recombination, is mitigated by the additives.

In one non-limiting embodiment, the waste plastics pyrolysis stream may be from almost any type of polymer or plastic. In a non-restrictive version, the plastic may include, but is not necessarily limited to, polyethylene (PE), polypropylene (PP), polyvinylchloride (PVC), polyethylene terephthalate (PETE), polystyrene (PS), polyurethane, polycarbonate (PC), polyamide, polymethyl Methacrylate (PMMA), and combinations thereof.

Suitable additives include, but are not necessarily limited to, crude oil demulsifiers, crude oil wax control additives, crude oil pour point reducers, dispersants/antifoulants, nanoscale metallic oxides, overbased metal oxide carbonates, and combinations thereof. In more specific, but non-limiting embodiments, suitable crude oil demulsifiers include, but are not limited to, ethoxylated and/or propoxylated alkylphenol formaldehyde resins. Suitable crude oil wax control additives include, but are not necessarily limited to, poly(ethylene-co-vinylacetate). Suitable crude oil pour point reducers include, but are not necessarily limited to, ethylene vinyl acetates. Suitable dispersants/antifoulants include, but are not necessarily limited to, maleic anhydride/olefin polymers from olefins having C16-C18 carbon atoms and weight average molecular weights of from about 200 to about 300 as well as functionalized derivatives of maleic anhydride/olefin polymers having weight average molecular weights of from about 250 to about 350. More specifically, suitable functionalized derivatives of maleic anhydride/olefin polymers include, but are not necessarily limited to, amine/polyamine derivatives, copolymers of butadiene and C16-C18 anhydrides, alcohol/polyalcohol derivatives, carboxylic/fatty acid derivatives, and combinations thereof. Suitable additives may also include nanoscale metallic oxides that are magnesium oxide and/or calcium oxide. In a non-limiting example, a suitable overbased metal oxide carbonate is magnesium oxide overbase.

In another non-restrictive version, the effective amount of the additive introduced into the waste plastics pyrolysis stream ranges from about 10 independently to about 3000 ppm based on the waste plastics pyrolysis stream; alternatively, from about 100 independently to about 300 ppm. The term "independently" when used herein with respect to a range means that any endpoint may be combined with any other endpoint to give a suitable alternative range. For instance, a range of from about 10 ppm to about 300 ppm would be acceptable.

The temperature of the method is important because the waste plastics pyrolysis stream must be liquid and flowable to be processed. Thus, in one non-limiting embodiment, the temperature should be from about 100° C. independently to about 400° C.; alternatively, from about 150° C. independently to about 250° C.

Introducing the additive into the waste plastics pyrolysis stream may be accomplished by any suitable method. Mixing of the additive with the waste plastics pyrolysis stream should produce a good dispersion of the additive, which in one non-limiting embodiment includes introducing the additive while transferring the waste plastic resid product upstream of a pump that will impart shear stress and mixing. Injection may optionally be made with a good mixing device, such as a quill, which tends to generate small droplets of the additive liquid carrier in a solvent.

Suitable solvents for delivering the additive include, but are not necessarily limited to, gasoil, vacuum gasoil, fluid catalytic cracking light cycle oil, fluid catalytic cracking heavy cycle oil and fluid catalytic cracking slurry oil, ethylene cracker pyrolysis gasoline, ethylene cracker pyrolysis fuel oil, kerosene, naphtha and gasoline. The amount of the additive in the solvent may range from about 1:1 independently to about 50:1; alternatively, from about 5:1 independently to about 10:2 solvent to additive (solvent: additive) ratio by volume.

The method also includes separating the contaminants from the waste plastics pyrolysis stream by a physical process. Suitable physical separation processes include, but are not necessarily limited to, gravity settling, centrifugation, cyclones, and combinations thereof.

The invention will now be described with respect to particular embodiments which are not intended to limit the invention in any way, but which are simply to further highlight or illustrate the invention. All percentages (%) are weight percentages unless otherwise noted.

Example 1

Removal of Solids by Settling

Figure 2:
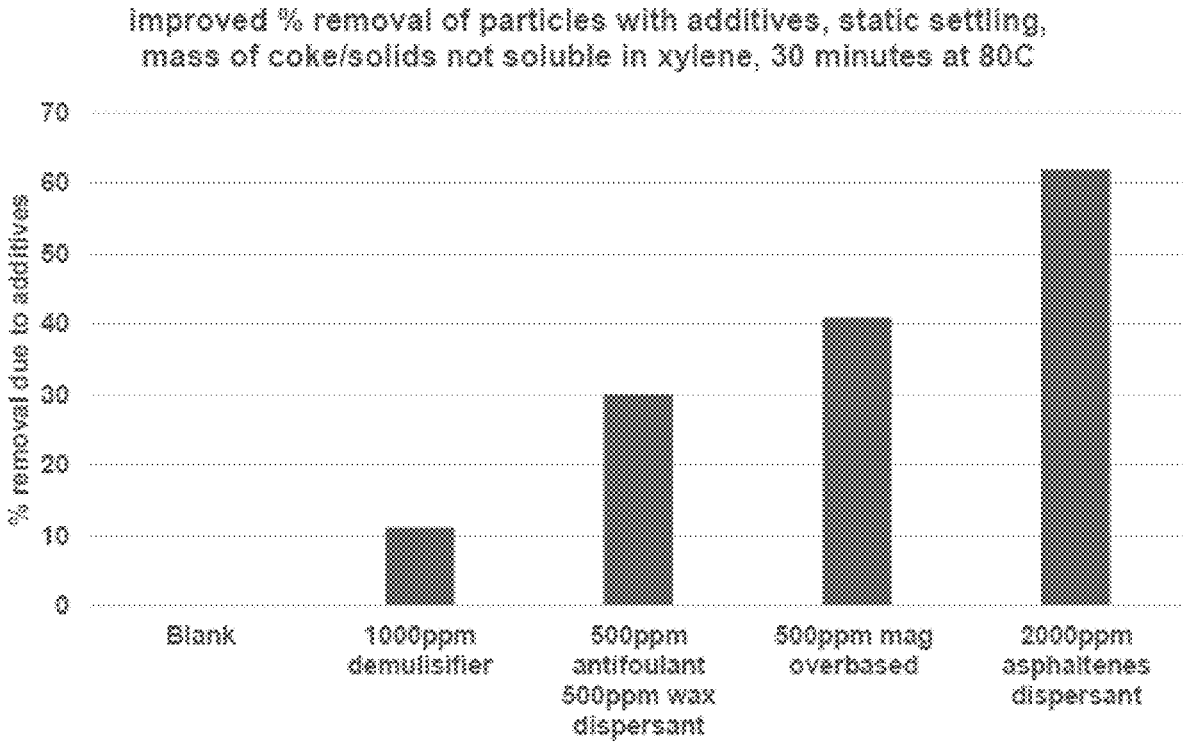
FIG. 2 is a bar chart of improved percentage removal of contaminant particles from waste plastic residuum showing a blank and four different additives at the indicated dosages after 30 minutes static settling at 80° C. for coke/solids not soluble in xylene.

FIG. 1 is a graph of coke and other solids that are insoluble in xylene and not removed as a function of size for waste plastic residuum intended for a fuel process of a blank and three examples using different additives at the indicated dosages after 30 minutes static settling at 80° C. The residuum was from waste plastic that was a mixture of municipal waste plastics containing a wide range of plastic, including polyethylene (PE), polypropylene (PP), polyvinylchloride (PVC), polyethylene terephthalate (PETE), polystyrene (PS), polyurethane, polycarbonate (PC), polyamide, polymethyl methacrylate (PMMA). The inventive runs used 1000 ppm demulsifier; a mixture of 500 ppm antifoulant and 500 ppm wax dispersant, and 500 ppm magnesium overbase. The magnesium overbase is an emulsion of colloidal magnesium in a water phase dispersed in a hydrocarbon phase by a surfactant. The basicity of the oxide in the water phase is controlled/reduced by bubbling $CO_2$ through the emulsion. Demulsifiers were based on ethoxylated/propoxylated alkylphenol formaldehyde resins, and the antifoulant was based on maleic anhydride ester of hexadecane (C16) alpha olefins. The wax dispersant was composed of poly(ethylene-co-vinylacetate, while the "mag overbased" was based on nanocolloid of emulsified magnesium oxide overbased FIG. 2 is a graph of coke and other solids that are insoluble in xylene and not removed as a function of size for waste plastic residuum of a blank and the three examples using different additives at the indicated dosages after 30 minutes static settling at 80° C. in FIG. 1. It may be seen that each of the three additives removed solids as compared with the blank. For FIG. 1, samples were taken from the top of the settler.

FIG. 2 is a bar chart showing improved percentage removal of contaminant particles from the waste plastic residuum of FIGS. 1 and 2 showing the blank and four different additives at the indicated dosages after 30 minutes static settling at 80° C. for coke/solids not soluble in xylene, where the order of improvement was 2000 ppm asphaltenes dispersant (which is the same as the antifoulant)>500 ppm magnesium overbase>500 ppm antifoulant+500 ppm wax dispersant>1000 ppm demulsifier>blank. Samples were taken from the top of the settler. The contaminants are coke and other solids not soluble in xylene.

Figure 3A:
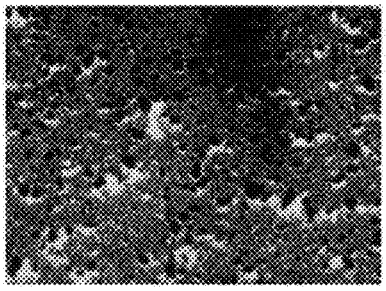
Figure 3B:
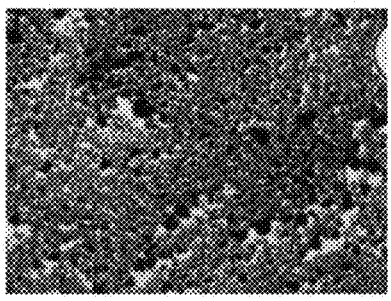
Figure 3C:
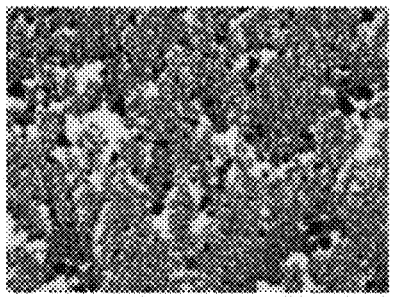

FIG. 3 is a series of microphotographs of unsettled material on top of the settler after 30 minutes of static settling at 80° C. for the blank (FIG. 3A), after treatment with the demulsifier (FIG. 3B), and after treatment with the combination of phosphate ester crude antifoulant and crude wax dispersant (FIG. 3C). It may be seen that less residual material is seen these Figures on the order of FIG. 3C<FIG. 3B<FIG. 3A, where less residual material is the goal.

Figure 4A:
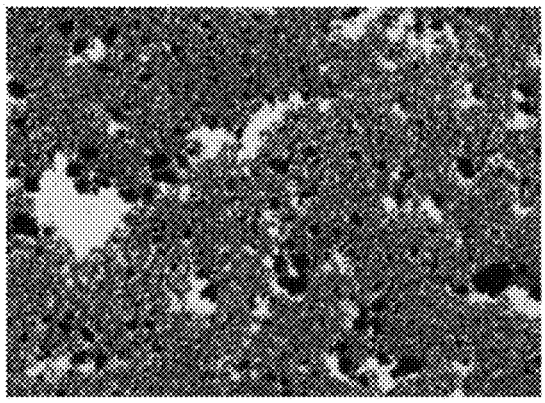
Figure 4B:
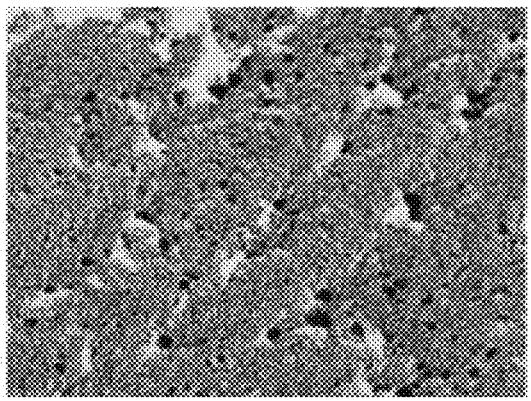

FIG. 4 is two microphotographs of unsettled material on top of the settler after 30 minutes of static settling at 80° C. where FIG. 4A shows results after treatment with a mag overbase and FIG. 4B shows results after treatment with a dispersant. FIG. 4B shows better results as compared with FIG. 4A.

Example 2

Removal of Solids by Centrifugation

Figure 5:
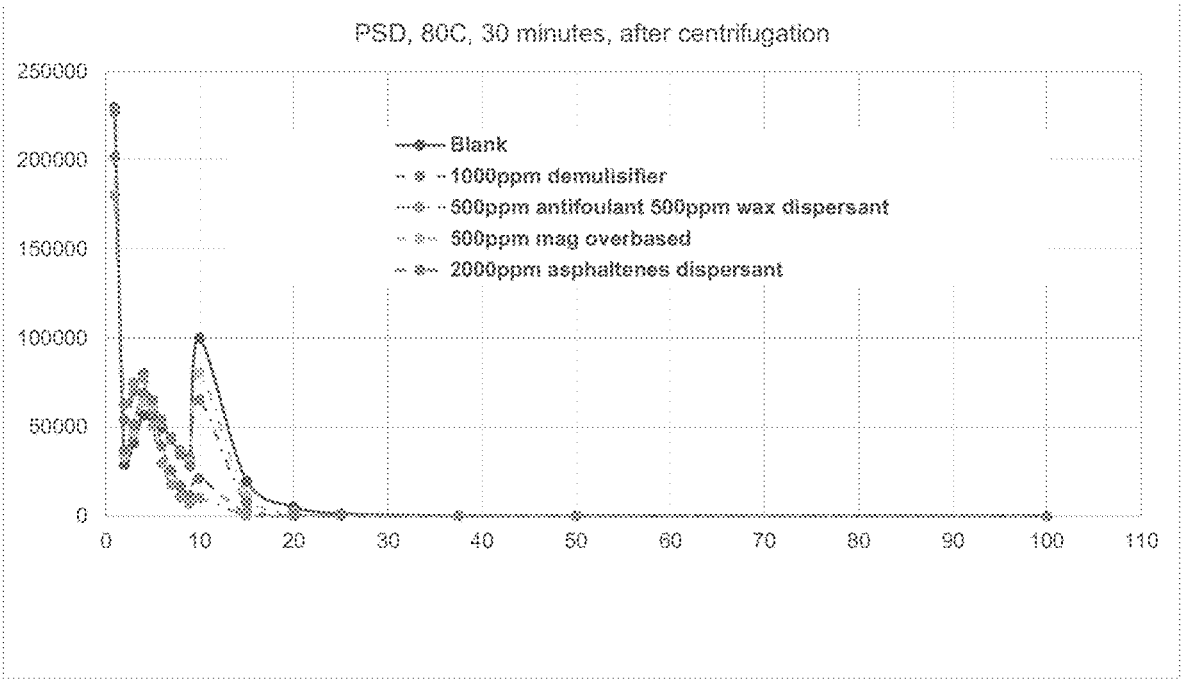
FIG. 5 is a graph of solids that are not removed as a function of size for waste plastic residuum of a blank and four examples using different additives at the indicated dosages after 30 minutes of centrifugation at 1850 rpm and 80° C.

FIG. 5 is a graph of solids that are not removed as a function of size for waste plastic residuum intended for a fuel process of a blank and three examples using different additives at the indicated dosages after 30 minutes centrifugation at 1850 rpm at 80° C. The residuum was from the same waste plastic that was used for tests reported in FIGS. 1-4 and processed at the same conditions. Therefore, the waste plastic used for these tests is the same as for the settling tests noted in Example 1. The inventive runs used 1000 ppm demulsifier; a mixture of 500 ppm antifoulant and 500 ppm wax dispersant, 500 ppm magnesium overbase, and 2000 ppm asphaltene dispersant. The magnesium overbase is an emulsion of colloidal magnesium in a water phase dispersed in a hydrocarbon phase by a surfactant. The basicity of the oxide in the water phase is controlled/reduced by bubbling $CO_2$ through the emulsion.

Demulsifiers were based on ethoxylated/propoxylated alkylphenol formaldehyde resins, and the antifoulant was based on maleic anhydride ester of hexadecane (C16) alpha olefins. The wax dispersant was composed of poly(ethylene-co-vinylacetate, while the "mag overbased" was based on a nanocolloid of emulsified magnesium oxide overbase.

Figure 6:
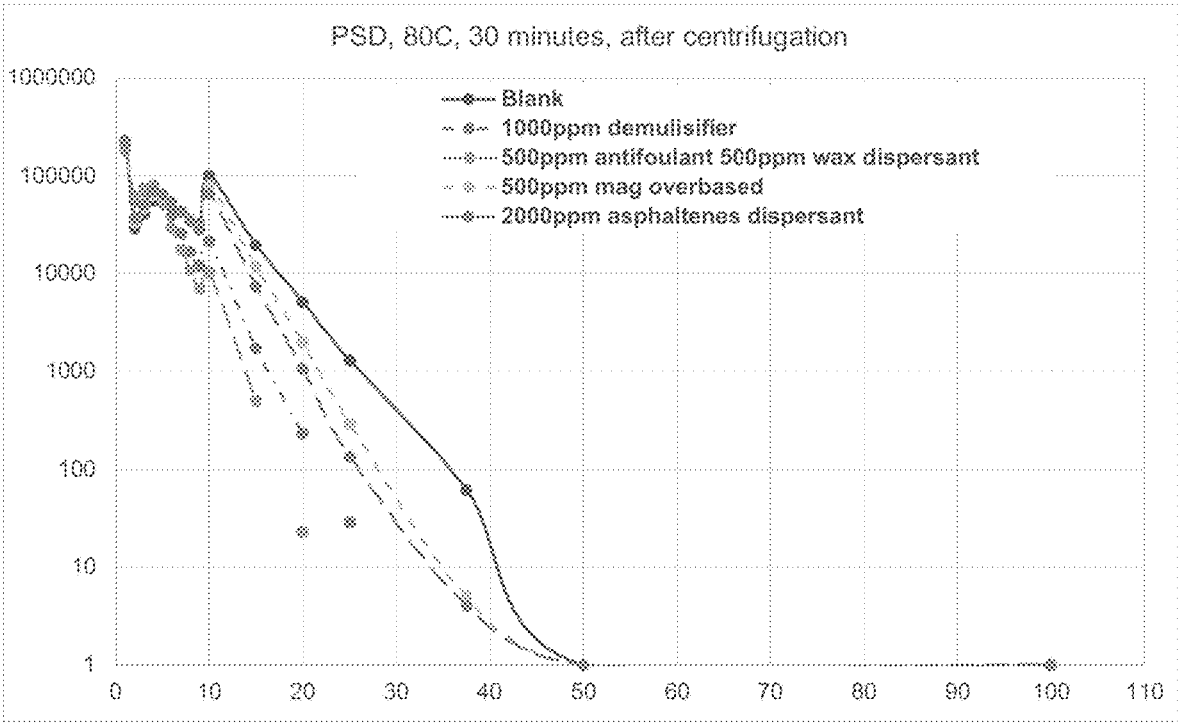
FIG. 6 is a graph of solids that are not removed as a function of size for waste plastic residuum of a blank and four examples using different additives at the indicated dosages after 30 minutes of centrifugation at 1850 rpm and 80° C.

FIG. 6 is a graph of solids that are not removed as a function of size for waste plastic residuum of a blank and the four examples using different additives at the indicated dosages after 30 minutes centrifugation at 1850 rpm at 80° C. in FIG. 6. Centrifugation shows a better removal of solids. It may be seen that each of the three additives removed solids as compared with the blank. For both FIGS. 5 and 6, samples were taken from the top of the tube after centrifugation.

Figure 7:
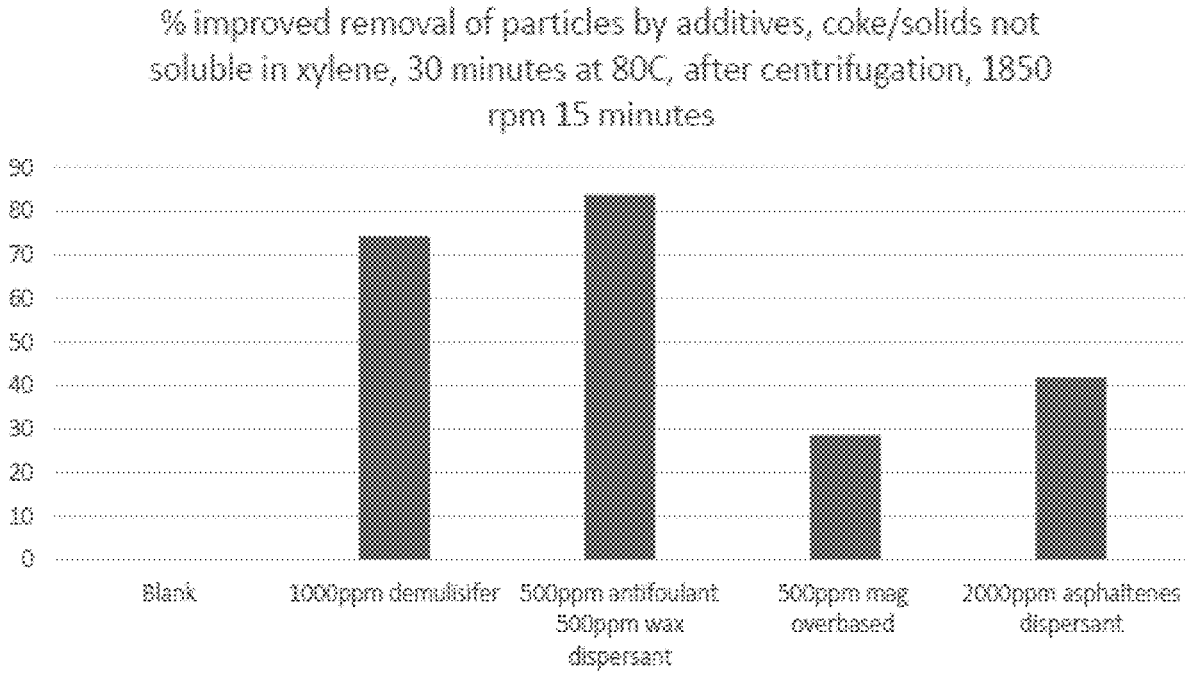
FIG. 7 is a bar chart of improved percentage removal of contaminant particles from waste plastic residuum showing a blank and four different additives at the indicated dosages after 30 minutes of centrifugation at 1850 rpm and 80° C.

FIG. 7 is a bar chart showing improved percentage removal of contaminant particles from the waste plastic residuum of FIGS. 5 and 6 showing the blank and four different additives at the indicated dosages after 30 minutes centrifugation at 1850 rpm at 80° C. for coke/solids not soluble in xylene, where the order of improvement was 500 ppm antifoulant+500 ppm wax dispersant>1000 ppm demulsifier>2000 ppm asphaltenes dispersant (which is the same as the antifoulant)>500 ppm magnesium overbase>blank. Samples were taken from the top of the settler. The contaminants are coke and other solids not soluble in xylene.

Figure 8A:
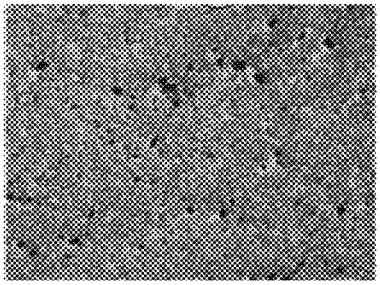
Figure 8B:
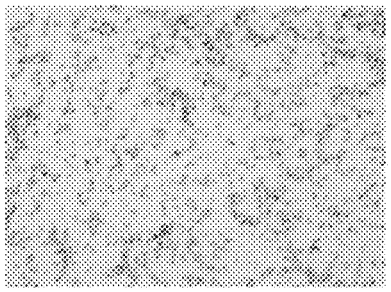
Figure 8C:
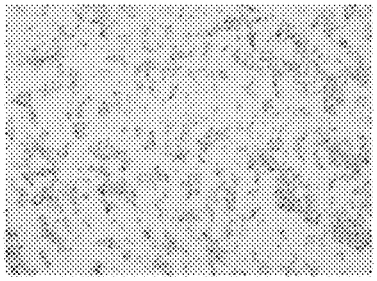

FIG. 8 is a series of microphotographs of unsettled material on top of the settler after 30 minutes of centrifugation at 1850 rpm at 80° C. for the blank (FIG. 8A), after treatment with the demulsifier (FIG. 8B), and after treatment with the combination of phosphate ester crude antifoulant and crude wax dispersant (FIG. 8C). It may be seen that less residual material is seen these Figures on the order of FIG. 8C<FIG. 8<FIG. 8A, where less residual material is the goal.

Figure 9A:
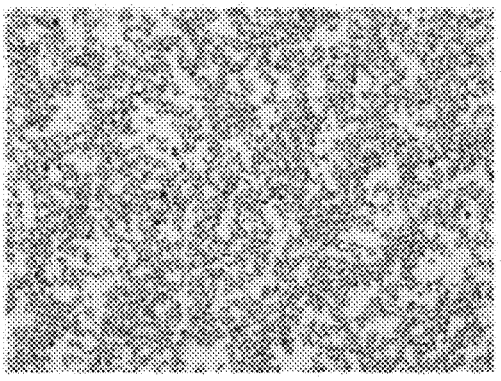
Figure 9B:
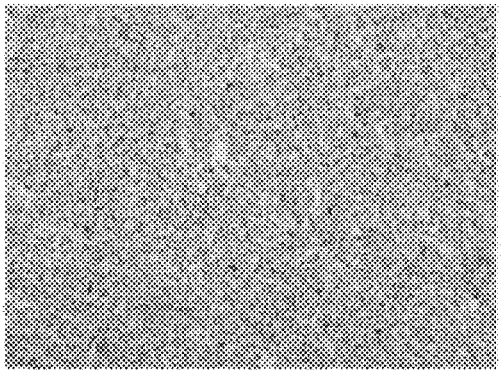

FIG. 9 is two microphotographs of unsettled material on top of the settler after 30 minutes of centrifugation at 1850 rpm at 80° C. where FIG. 9A shows results after treatment with a mag overbase and FIG. 10B shows results after treatment with a dispersant. FIG. 10B shows finer and total less unsettled material compared with FIG. 9A.

In the foregoing specification, the invention has been described with reference to specific embodiments thereof, and has been described as effective in providing methods and compositions for removing contaminants, particularly solid contaminants from waste plastics pyrolysis streams. However, it will be evident that various modifications and changes can be made thereto without departing from the broader scope of the invention. Accordingly, the specification is to be regarded in an illustrative rather than a restrictive sense. For example, specific waste plastics pyrolysis streams, crude oil demulsifiers, crude oil wax control additives, crude oil pour point reducers, dispersants, antifoulants, nanoscale metallic oxides, overbased metal oxide carbonates, solvents, proportions, dosages, treatment conditions, physical separation processes, and other components and procedures falling within the claimed parameters, but not specifically identified or tried in a particular method or composition, are expected to be within the scope of this invention.

The present invention may suitably comprise, consist or consist essentially of the elements disclosed and may be practiced in the absence of an element not disclosed. For instance, there may be provided a method for removing contaminants from a waste plastics pyrolysis stream containing the contaminants, where the method comprises, consists essentially of, or consists of, introducing to the waste plastics pyrolysis stream containing contaminants an effective amount to at least partially remove the contaminants therefrom at least one additive selected from the group consisting of crude oil demulsifiers, crude oil wax control additives, crude oil pour point reducers, dispersants/antifoulants, nanoscale metallic oxides, overbased metal oxide carbonates, and combinations thereof; and separating the contaminants from the waste plastics pyrolysis stream by a physical process.

Alternatively, there may be provided a treated waste plastics pyrolysis stream that comprises, consists essentially of, or consists of, waste plastics from pyrolysis, contaminants, an effective amount of an additive to at least partially remove the contaminants from the waste plastics pyrolysis stream, where the additive is selected from the group consisting of crude oil demulsifiers, crude oil wax control additives, crude oil pour point reducers, dispersants/antifoulants, nanoscale metallic oxides, overbased metal oxide carbonates, and combinations thereof.

In another non-restrictive version, the only dispersant or antifoulant in the additive is one or more waste plastic as defined herein.

The words "comprising" and "comprises" as used throughout, are to be interpreted to mean "including but not limited to" and "includes but not limited to", respectively.

As used herein, the singular forms "a," "an," and "the" are intended to include the plural forms as well, unless the context clearly indicates otherwise.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

What is claimed is:

1. A method for removing contaminants from a waste plastics pyrolysis stream containing the contaminants, the method comprising:

introducing to the waste plastics pyrolysis stream containing contaminants an effective amount to at least partially remove the contaminants therefrom of at least one additive selected from the group consisting of crude oil demulsifiers, crude oil wax control additives, crude oil pour point reducers, dispersants/antifoulants, overbased metal oxide carbonates, and combinations thereof; and separating the contaminants from the waste plastics pyrolysis stream by a physical process, where the waste plastics pyrolysis stream is liquid and is at a temperature between about 100° C. and about 400° C.

2. The method of claim 1 where in the waste plastics pyrolysis stream, the plastic is selected from the group consisting of polyethylene, polypropylene, polyvinylchloride, polyethylene terephthalate, polystyrene, polyurethane, polycarbonate, polyamide, polymethyl methacrylate, and combinations thereof.

3. The method of claim 1 where:

the crude oil demulsifiers are selected from the group consisting of ethoxylated and/or propoxylated alkylphenol formaldehyde resins;

the crude oil wax control additives are selected from the group consisting of poly(ethylene-co-vinylacetate);

the crude oil pour point reducers are selected from the group consisting of ethylene vinyl acetates;

the dispersants/antifoulants are selected from the group consisting of:

the maleic anhydride/olefin polymers from olefins having C16-C18 carbon atoms and weight average molecular weights of from about 200 to about 300;

the functionalized derivatives of maleic anhydride/olefin polymers having weight average molecular weights of from about 250 to about 350, selected from the group consisting of amine/polyamine derivatives, copolymers of butadiene and C16/C18 anhydrides, alcohol/polyalcohol derivatives, carboxylic/fatty acid derivatives, and combinations thereof; and the overbased metal oxide carbonate is magnesium oxide overbase.

4. The method of claim 1 where the effective amount of the additive ranges from about 10 to about 3000 ppm based on the waste plastics pyrolysis stream.

5. The method of claim 1 where the physical separation process is selected from the group consisting of gravity settling, centrifugation, cyclones, and combinations thereof.

6. The method of claim 1 where the contaminants are solids.

7. The method of claim 1 where the additive is present in a solvent where:

the solvent is selected from the group consisting of gasoil, vacuum gasoil, fluid catalytic cracking light cycle oil, fluid catalytic cracking heavy cycle oil and fluid catalytic cracking slurry oil, ethylene cracker pyrolysis gasoline, ethylene cracker pyrolysis fuel oil, kerosene, naphtha, gasoline, and combinations thereof; and the amount of additive in the solvent ranges from about 1:1 to about 50:1 solvent:additive by volume.

8. A method for removing contaminants from a waste plastics pyrolysis stream containing the contaminants, the method comprising:

introducing to the waste plastics pyrolysis stream containing contaminants an effective amount to at least partially remove the contaminants therefrom of at least one additive selected from the group consisting of crude oil demulsifiers, crude oil wax control additives, crude oil pour point reducers, dispersants/antifoulants, overbased metal oxide carbonates, and combinations thereof, where the effective amount of the at least one additive is from about 10 to about 3000 ppm based on the waste plastics pyrolysis stream, where the plastic in the waste plastics pyrolysis stream is selected from the group consisting of polyethylene, polypropylene, polyvinylchloride, polyethylene terephthalate, polystyrene, polyurethane, polycarbonate, polyamide, polymethyl methacrylate, and combinations thereof; and separating the contaminants from the waste plastics pyrolysis stream by a physical process, where the waste plastics pyrolysis stream is liquid and is at a temperature between about 100° C. and about 400° C.

9. The method of claim 8 where the physical separation process is selected from the group consisting of gravity settling, centrifugation, cyclones, and combinations thereof.

10. The method of claim 8 where the contaminants are solids selected from the group consisting of carbon material, carbon-type materials, organic polymers, inorganic solids, metal particles, metals trapped within solids, and combinations of these.

11. A method for removing contaminants from a waste plastics pyrolysis stream containing the contaminants, the method comprising:

introducing to the waste plastics pyrolysis stream containing contaminants an effective amount to at least partially remove the contaminants therefrom of at least one additive selected from the group consisting of crude oil demulsifiers, crude oil wax control additives, crude oil pour point reducers, dispersants/antifoulants, overbased metal oxide carbonates, and combinations thereof; and separating the contaminants from the waste plastics pyrolysis stream by a physical process, where the at least one additive is present in a solvent selected from the group consisting of gasoil, vacuum gasoil, fluid catalytic cracking light cycle oil, fluid catalytic cracking heavy cycle oil and fluid catalytic cracking slurry oil, ethylene cracker pyrolysis gasoline, ethylene cracker pyrolysis fuel oil, kerosene, naphtha, gasoline, and combinations thereof, where the amount of additive in the solvent ranges from about 1:1 to about 50:1 solvent:additive by volume.

* * * * *